US006253542B1

(12) United States Patent
Omara et al.

(10) Patent No.: US 6,253,542 B1
(45) Date of Patent: Jul. 3, 2001

(54) AIR-FUEL RATIO FEEDBACK CONTROL

(75) Inventors: Ahmed Abdelaziz Omara, Ann Arbor; Douglas Ray Hamburg, Bloomfield Hills; John Edward Bradley, Dearborn, all of MI (US)

(73) Assignee: Ford Global Technologies, Inc., Dearborn, MI (US)

( * ) Notice: Subject to any disclaimer, the term of this patent is extended or adjusted under 35 U.S.C. 154(b) by 0 days.

(21) Appl. No.: 09/375,351

(22) Filed: Aug. 17, 1999

(51) Int. Cl.[7] ..... F01N 3/00

(52) U.S. Cl. ..... 60/274; 60/285; 123/492; 123/489

(58) Field of Search ..... 60/274, 285; 123/492, 123/489

(56) References Cited

U.S. PATENT DOCUMENTS

| | | | | |
|---|---|---|---|---|
| 4,357,923 | * | 11/1982 | Hideg | 123/492 |
| 4,869,222 | * | 9/1989 | Klassen | 123/489 |
| 5,168,700 | | 12/1992 | Furuya . | |
| 5,255,512 | | 10/1993 | Hamburg et al. . | |
| 5,359,852 | | 11/1994 | Curran et al. . | |
| 5,379,591 | | 1/1995 | Iwata et al. . | |
| 5,390,490 | * | 2/1995 | Brooks | 60/285 |
| 5,400,592 | * | 3/1995 | Mukaihira et al. | 60/274 |
| 5,417,060 | * | 5/1995 | Ishida et al. | 60/285 |
| 5,475,975 | | 12/1995 | Nasu . | |
| 5,557,933 | * | 9/1996 | Numata et al. | 60/274 |
| 5,657,627 | | 8/1997 | Akazaki et al. . | |
| 5,842,340 | | 12/1998 | Bush et al. . | |
| 5,848,528 | | 12/1998 | Liu . | |
| 5,852,930 | | 12/1998 | Yasui et al. . | |
| 5,865,026 | * | 2/1999 | Davey et al. | 60/274 |
| 5,953,905 | * | 9/1999 | Jerger et al. | 60/274 |

* cited by examiner

*Primary Examiner*—Thomas Denion
*Assistant Examiner*—Thai-Ba Trieu
(74) *Attorney, Agent, or Firm*—Allen J. Lippa

(57) ABSTRACT

A method of controlling the air-fuel ratio of an internal combustion engine having an exhaust passage including a catalytic converter. The method includes providing a first air-fuel ratio sensor upstream of the catalytic converter, and providing a second air-fuel ratio sensor downstream of the catalytic converter. A control module having an input connected to the first and second air-fuel ratio sensors and an output connected to actuators for controlling the engine is also provided. This establishes a first feedback loop including the first air-fuel ratio sensor and a second feedback loop including the second air-fuel ratio sensor. The method further includes detecting an output value of the second air-fuel ratio indicative of a rich or lean exhaust gas air-fuel ratio. In response to the output value, the system monitors the engine mass airflow, and controls the duration of air-fuel ratio of the engine as a function of the engine mass airflow.

14 Claims, 3 Drawing Sheets

AIR-FUEL RATIO FEEDBACK CONTROL

BACKGROUND OF THE INVENTION

1. Field of the Invention

The present invention relates to an air-fuel ratio control device for an internal combustion engine and, more specifically, relates to an air-fuel ratio control device which controls the air-fuel ratio of the engine based on the outputs of air-fuel ratio sensors upstream and downstream of a catalytic converter.

2. Description of the Related Art

Three-way reducing and oxidizing catalytic converters are commonly used to remove pollutants such as $NO_x$, HC, and CO components in the exhaust gas of an internal combustion engine. Generally, the catalyst used in such converters is able to remove the pollutants from the exhaust gas simultaneously only when the air-fuel ratio of the exhaust gas is kept in a narrow range near the stoichiometric air-fuel ratio. Therefore, in order to reduce the emission of the exhaust gas, it is important to keep the air-fuel ratio of the exhaust gas in the region near the stoichiometric air-fuel ratio.

It is known to use an electronic engine control module to control the amount of fuel being injected into an engine. In particular, it is known to use the output of an exhaust gas oxygen (EGO) sensor as part of a feedback control loop to control the air-fuel ratio. Typically, such an EGO sensor is placed upstream of the catalyst which processes the exhaust gases. In some applications, it is known to use a second EGO sensor downstream of the catalyst, partly to serve as a diagnostic measure of catalyst performance. With the presence of EGO sensors both upstream of the catalyst and downstream of the catalyst, it would be desirable to develop an improved feedback air-fuel ratio control system using signals from both of the sensors.

In the double EGO sensor system, the air-fuel ratio control is carried out based on the output of the downstream EGO sensor as well as the upstream EGO sensor. Typically, the air-fuel ratio of the engine is accurately controlled by correcting the output of the upstream EGO sensor based on the output of the downstream EGO sensor. In such a system, however, there exists a delay in the response of the downstream EGO sensor to detect a change in the exhaust gas air-fuel ratio of the engine. This delay is caused by the oxygen storage capacity of the three-way reducing and oxidizing catalyst in the catalytic converter. Thus, the response of the downstream EGO sensor to the change in the air-fuel ratio of the engine becomes slow due to the absorbing and releasing action of the oxygen by the catalyst. Because of this delay in the detection of the air-fuel ratio of the engine by the downstream EGO sensor, it is difficult to compensate the output of the upstream EGO sensor accurately based on the output of the downstream EGO sensor.

Attempts have been made to improve the air-fuel ratio correction capabilities of dual sensor control systems by substantially increasing the proportional feedback gain in the downstream EGO sensor feedback loop. Although this approach provides relatively rapid transient air-fuel ratio correction, it results in undesirable low frequency air-fuel ratio limit-cycle oscillations which reduce overall catalyst efficiency.

An example of this behavior is shown in FIG. 1. As shown in FIG. 1, some time after a lean air-fuel ratio disturbance occurs (at t=10 seconds), the downstream EGO sensor output 10 switches from a rich to a lean indication. The proportional feedback term derived from this change will then command the fuel controller to increase the fuel flow rate by a fixed amount. Because of the time delay associated with the downstream feedback loop (caused primarily by the oxygen storage component in the catalyst), the effect of this command will not be detected by the downstream EGO sensor for a relatively long time. In the meantime, the integral feedback term is slowly, but continuously, increasing the fuel flow rate. After a sufficiently long time delay, the effects of the increased fuel flow will be detected by the downstream EGO sensor, and the sensor output will switch back from lean to rich. In general, however, because of the fixed fuel offset induced by the proportional term, the air-fuel ratio correction will be excessive, and the cycle repeats itself as shown by the low frequency air-fuel ratio oscillations. At the same time, the pre-catalyst or upstream air-fuel ratio 12 oscillates, although at a somewhat higher amplitude.

SUMMARY OF THE INVENTION

It is an object of the present invention to provide an improved air-fuel ratio feedback control to solve the aforementioned problem. In the present invention, the aforementioned problem is solved through the provision of a method of controlling the air-fuel ratio of an internal combustion engine having an exhaust passage including a catalytic converter. The method includes providing a first air-fuel ratio sensor upstream of the catalytic converter, and providing a second air-fuel ratio sensor downstream of the catalytic converter. A control module having an input connected to the first and second air-fuel ratio sensors and an output connected to actuators for controlling the engine is also provided. This establishes a first feedback loop including the first air-fuel ratio sensor and a second feedback loop including the second air-fuel ratio sensor. The method further includes detecting an output value of the second air-fuel ratio indicative of a rich or lean exhaust gas air-fuel ratio. In response to the output value, the system monitors the engine mass airflow, and controls the air-fuel ratio as a function of the engine mass airflow.

One advantage of the present invention is that it suppresses fluctuation in the air-fuel ratio. Another advantage is that it improves the efficiency of the catalytic converter.

Other objects and advantages of the invention will become apparent upon reading the following detailed description and appended claims, and upon reference to the accompanying drawings.

BRIEF DESCRIPTION OF THE DRAWINGS

For a more complete understanding of this invention, reference should now be had to the embodiments illustrated in greater detail in the accompanying drawings and described below by way of examples of the invention. In the drawings.

DETAILED DESCRIPTION OF THE INVENTION

Figure 2:
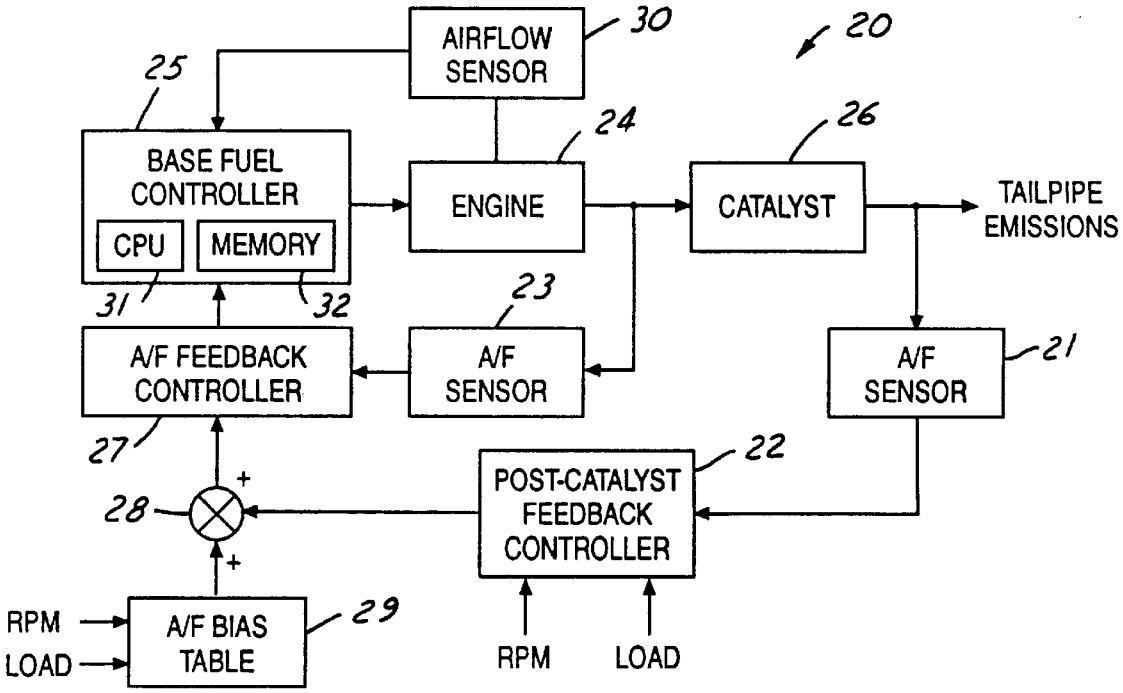
FIG. 2 is a simplified block diagram of one embodiment of a two-sensor air-fuel ratio feedback control system according to the present invention.

Referring to FIG. 2, an air-fuel ratio control system 20 in accordance with one embodiment of the present invention uses feedback from a post-catalyst air-fuel ratio sensor 21 to appropriately bias existing values which are stored in an air-fuel ratio bias table 29. The air-fuel ratio sensor 21 is preferably a heated exhaust gas oxygen sensor (HEGO).

A base fuel controller 25 is coupled to provide an input to an engine 24. Base fuel controller 25 controls, among other things, the air-fuel ratio delivered to the cylinders of the engine 24 in accordance with signals received from the air-fuel ratio feedback controller 27. The base fuel controller 25 includes a central processing unit 31, such as a microprocessor and associated memory 32. Memory 32 can include read-only memory (ROM) for storing a main routine and interrupt routine, such as the fuel injection routine and an ignition timing routine, and random access memory (RAM) for storing temporary data.

In the exhaust system, a three-way reducing and oxidizing catalytic converter 26 is disposed in the exhaust passage downstream of the exhaust manifold of the engine 24. The catalyst 26 has an $O_2$ storage capacity and is capable of removing three pollutants from the exhaust gas, i.e., CO, HC, and $NO_x$, simultaneously.

A first upstream air-fuel ratio sensor 23 is provided at the exhaust manifold upstream of the catalyst 26, and a second downstream air-fuel ratio sensor 21 is disposed at the tailpipe downstream of the catalyst 26. In this case, both the upstream and downstream air-fuel ratio sensors 23, 21, are preferably HEGO sensors. The upstream air-fuel ratio sensor 23 generates a pre-catalyst HEGO sensor feedback signal. The downstream air-fuel ratio sensor 21 generates a post-catalyst HEGO sensor feedback signal. More specifically, the upstream air-fuel ratio sensor 23 generates a continuous voltage output corresponding to the air-fuel ratio of the exhaust gas. The downstream air-fuel ratio sensor 21 also generates an output signal corresponding to the air-fuel ratio of the exhaust gas downstream of the catalyst 26.

The air-fuel ratio feedback control system 20 includes an air-fuel ratio bias table 29 which supplies, through a summer 28, a bias signal to an air-fuel ratio feedback controller 27 for changing the closed-looped air-fuel ratio control point of the proportional integral (PI) controller which is the air-fuel ratio feedback controller 27. These changes are made as a function of the engine speed and load. The bias signal corrects for the different operating characteristics of the pre-catalyst air-fuel ratio sensor 23 at different engine speeds and loads. The summer 28 also receives a signal from the post-catalyst air-fuel ratio sensor feedback controller 22 which has the effect of modifying the bias table signal. This moves the table values up or down and is done primarily to correct for aging and other offsets of the pre-catalyst air-fuel ratio sensor 23.

The air-fuel ratio bias table 29 is a multi-cell table which contains correction values that are used to shift the closed-loop air-fuel control point of the engine 24 as a function of engine speed and load. Various methods can be used to actually shift the engine air-fuel ratio. These methods include changing the switch point reference of the pre-catalyst air-fuel ratio sensor 23, changing the up/down integration rates and/or jump back values of the pre-catalyst feedback loop, or changing the relative lean-to-rich and rich-to-lean switching delays associated with the pre-catalyst air-fuel ratio sensor 23. One method of updating the values in the air-fuel ratio bias table 29 is disclosed in U.S. Pat. No. 5,359,852 which is herein incorporated by reference.

An airflow sensor 30 such as a MAF sensor is coupled to the engine 24 to measure the intake air flow. This signal is provided to the base fuel controller 25 to determine the length of time the high post-catalyst proportional feedback gain is active following an air-fuel ratio disturbance detected downstream of the catalyst 26. This process is described more fully with reference to FIG. 3. Alternatively, exhaust mass flow can be directly measured using an appropriated sensor.

In operation, the output of the post-catalyst air-fuel ratio sensor 21 is processed by a voltage comparator circuit which produces a "rich" signal when the engine air-fuel ratio is on the rich side of the catalyst window. When a "rich" signal is produced, the post-catalyst feedback controller 22 quickly applies a large lean (proportional) correction value into a positive input of the summer 28. This high gain value is maintained for a period of time determined by the engine airflow as measured by the airflow sensor 30. Similarly, when a "lean" signal is produced, the feedback controller 22 will quickly apply a large rich (proportional) correction value into the positive input of the summer 28 for a period of time determined as a function of the engine air flow.

Figure 3:
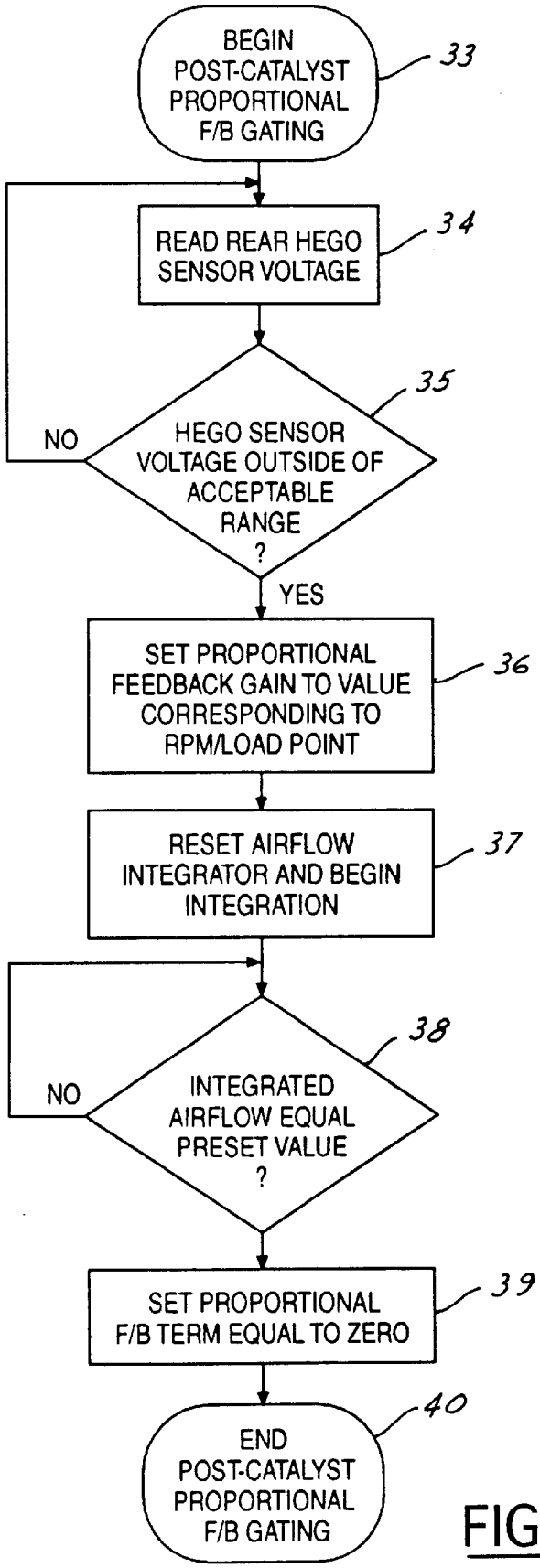
FIG. 3 is a logic flow diagram representing one method of controlling the air-fuel ratio feedback control system of FIG. 2.

FIG. 3 shows a simplified logic flow diagram for controlling the engine air-fuel ratio by limiting the duration of the high gain proportional feedback term of the post-catalyst feedback controller 22. This logic routine resides in the memory 32 of the base fuel controller 25 and is executed by the CPU 31.

In general, the logic limits the duration of the proportional feedback term of the post-catalyst feedback controller 22 so that once the oxygen storage component of the catalyst 26 is reset, the proportional term is gated off. The magnitude and duration of the gated proportional feedback term is chosen such that the oxygen storage component of the catalyst 26 is maintained about its midpoint. In other words, it is neither saturated with oxygen nor completely depleted of oxygen. Thus, the catalyst 26 is capable of absorbing oxygen in the exhaust gas when the air-fuel ratio of the exhaust gas is lean compared with the stoichiometric air-fuel ratio, and release absorbed oxygen when the air-fuel ratio of the exhaust gas is rich compared with the stoichiometric air-fuel ratio. As a result, the atmosphere at the outlet of the catalytic converter 26 is maintained near the stoichiometric air-fuel ratio even when the air-fuel ratio of the exhaust gas deviates from the stoichiometric air-fuel ratio for a period of time. To maintain the oxygen storage component of the catalyst 26 at its midpoint, the duration of the gated proportional feedback term is controlled as a function of the integrated engine inlet air mass flow since this determines how fast the oxygen component is "reset." This table of duration values indexed by engine inlet mass airflow is readily created by known methods such as engine dynamometer testing and/or vehicle testing.

Referring to FIGS. 3, the post-catalyst proportional feedback gating subroutine begins at step 33. At step 34, the post-catalyst HEGO sensor voltage is sensed. At step 35, the post-catalyst HEGO sensor voltage is analyzed to determine whether it is outside a pre-determined acceptable range. Voltages outside this range correspond to an indication of a rich or lean exhaust gas air-fuel ratio. If the HEGO sensor voltage is not outside the acceptable range, i.e., the exhaust gas is near the stoichiometric air-fuel ratio, the logic returns to step 34. If the post-catalyst HEGO sensor voltage is outside of the acceptable range for a predetermined time interval such as one or two seconds, the logic flows to step 36. This time interval is necessary to prevent erroneous transient rich or lean indications. In step 36, the value of the proportional feedback gain in the post-catalyst feedback controller 22 (FIG. 2) is set to a value which is a function of the post-catalyst HEGO sensor voltage and the present engine load and speed. The optimum values generated by the post-catalyst feedback controller 22 are determined experimentally by known methods developed for the particular engine under consideration.

In step 37, the engine airflow integrator value is reset to zero in preparation for monitoring the airflow through the engine.

Step 38 monitors the total engine inlet mass airflow until it has reached a predetermined value corresponding to the amount of airflow which will approximately reset the oxygen storage component of the catalyst to its mid-point value. Again, this value will be unique to the known characteristics of the engine and catalyst within the system.

Once the engine airflow integrator has reached the predetermined value, the high gain proportional feedback signal is set equal to zero thus turning off the gain. Alternatively, the proportional feedback term can be significantly reduced rather than completely gated off. The subroutine terminates in step 40 and returns to the beginning at step 33 to cycle again.

Figure 1:
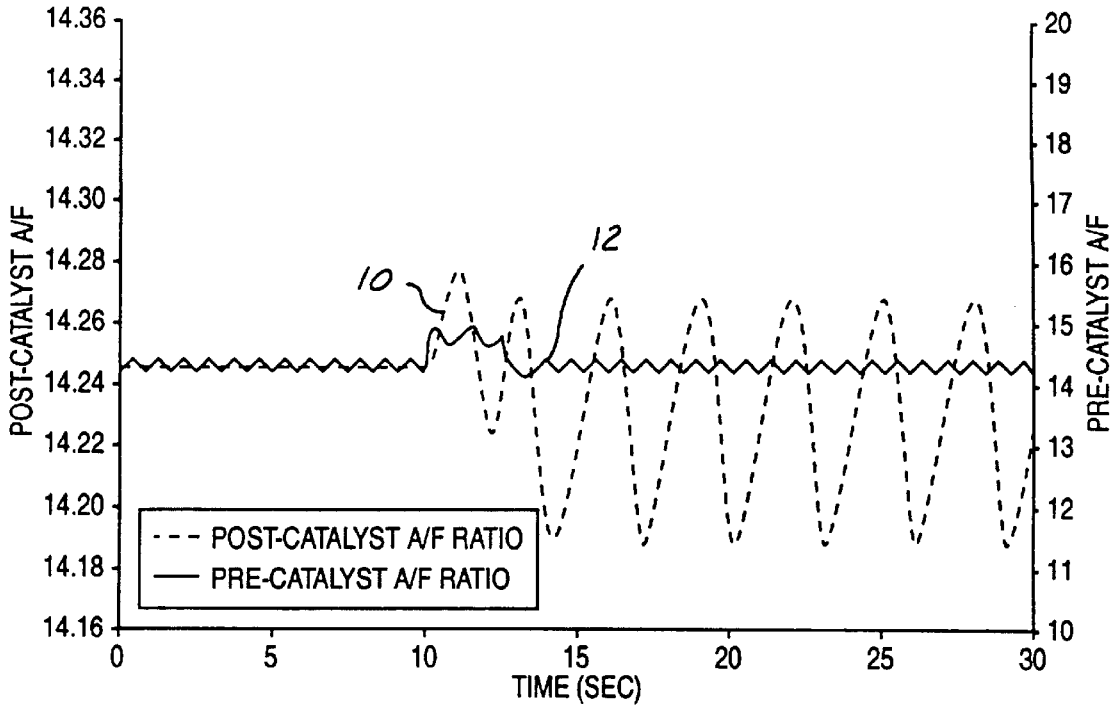
FIG. 1 is a graph of the pre-catalyst and post-catalyst air-fuel ratio versus time for a large post-catalyst feedback proportional gain.
Figure 4:
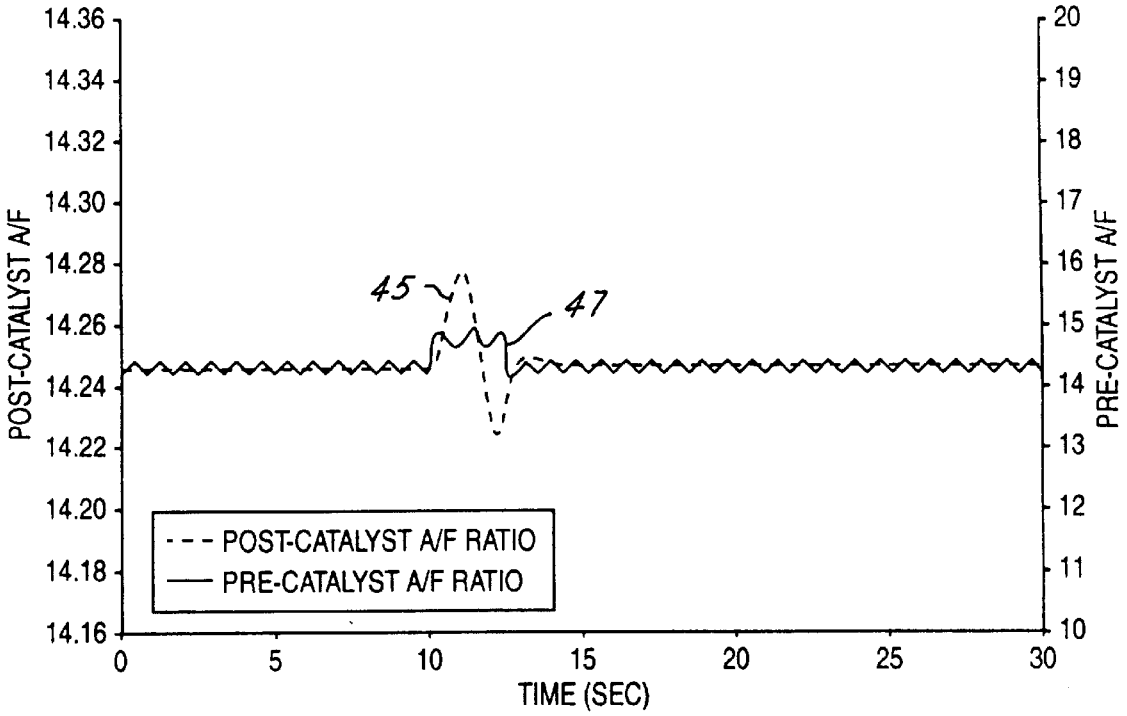
FIG. 4 is a graph of the pre-catalyst and post-catalyst air-fuel ratio versus time for the system of FIG. 2 using the present invention.

FIG. 4 shows a graph of the pre-catalyst and post-catalyst air-fuel ratio for the system of FIG. 1 when implemented with the logic routine just described. As can be seen in FIG. 4, for an air-fuel ratio disturbance at t=10 seconds, the downstream air-fuel ratio sensor output 45 switches from a stoichiometric to a lean indication. The proportional feedback term derived from this change then commands the base fuel controller 25 to increase the fuel flow rate by an amount related to the output voltage of the post-catalyst air-fuel ratio sensor and the engine speed and load. In this case, however, the value of the high post-catalyst proportional feedback gain is maintained for a duration of only 1.5 seconds following the air-fuel ratio disturbance. Thus, when the post-catalyst air-fuel ratio sensor output switches back from lean to rich, the fixed fuel offset induced by the proportional term of the post-catalyst feedback controller will be reduced (step 39), thereby enabling the system to stabilize. As can be seen in contrast to FIG. 1, the pre-catalyst air-fuel ratio 47 has reduced oscillations about the stoichiometric point and the post-catalyst air-fuel ratio 45 is quickly stabilized.

As FIG. 4 indicates, the post-catalyst proportional feedback gating method of the present invention allows for high HC, CO and $NO_x$ efficiency without undesirable catalyst breakthrough.

From the foregoing, it will be seen that there has been brought to the art a new and improved air-fuel ratio feedback control system which overcomes certain problems associated with dual air-fuel ratio sensor systems having high post-catalyst feedback controller proportional gain.

While the invention has been described in connection with one or more embodiments, it will be understood that the invention is not limited to those embodiments. On the contrary, the invention covers all alternatives, modifications, and equivalents, as may be included within the spirit and scope of the appended claims.

What is claimed is:

1. A method of controlling the air-fuel ratio of an internal combustion engine having an exhaust passage including a catalytic converter, the method comprising the steps of:

providing a first air-fuel ratio sensor for characterizing at least one constituent of an exhaust gas stream from the engine, the first air-fuel ratio sensor being positioned upstream of the catalytic converter;

providing a second air-fuel ratio sensor for characterizing at least one constituent of the exhaust gas stream from the engine, the second air-fuel ratio sensor being positioned downstream of the catalytic converter;

detecting an output value of the second air-fuel ratio sensor wherein the output value is indicative of a rich or lean exhaust gas air-fuel ratio and, in response;

monitoring the engine mass airflow; and modifying the air-fuel ratio of the engine by setting a proportional gain term of a feedback loop as a function of the output value and the engine speed and load, and reducing the proportional gain term as a function of the engine mass airflow.

2. The method as set forth in claim 1 wherein the step of detecting an output value of the second air-fuel ratio sensor includes the step of detecting an output value of the second air-fuel ratio sensor for a predetermined period of time such that said output value is indicative of a rich or lean exhaust gas air-fuel ratio.

3. The method as set forth in claim 1 wherein the step of monitoring the engine mass airflow includes the step of providing a mass airflow sensor proximate the intake of the engine.

4. The method as set forth in claim 1 wherein the step of monitoring the engine mass airflow includes the step of providing a mass airflow sensor proximate the exhaust of the engine.

5. The method as set forth in claim 1 wherein the step of reducing the proportional gain term as a function of the engine inlet mass airflow includes the step of turning the proportional gain term off.

6. A method of controlling the air-fuel ratio of an internal combustion engine having an exhaust passage including a catalytic converter, the method comprising the steps of:

providing a first air-fuel ratio sensor for characterizing at least one constituent of an exhaust gas stream from the engine, the first air-fuel ratio sensor being positioned upstream of the catalytic converter;

providing a second air-fuel ratio sensor for characterizing at least one constituent of the exhaust gas stream from the engine, the second air-fuel ratio sensor being positioned downstream of the catalytic converter;

detecting an output value of the second air-fuel ratio sensor for a predetermined period of time such that said output value is indicative of a rich or lean exhaust gas air-fuel ratio and, in response;

monitoring the engine mass airflow by integrating the total mass airflow through the intake of the engine; and modifying the air-fuel ratio of the engine as a function of the engine mass airflow.

7. A method of controlling the air-fuel ratio of an internal combustion engine having an exhaust passage including a catalytic converter, the method comprising the steps of:

providing a first air-fuel ratio sensor for characterizing at least one constituent of an exhaust gas stream from the engine, the first air-fuel ratio sensor being positioned upstream of the catalytic converter;

providing a second air-fuel ratio sensor for characterizing at least one constituent of the exhaust gas stream from the engine, the second air-fuel ratio sensor being positioned downstream of the catalytic converter;

providing a control module having an input connected to the first and second air-fuel ratio sensors and an output connected to actuators for controlling the engine, as to establish a first feedback loop including the first air-fuel ratio sensor and a second feedback loop including the second air-fuel ratio sensor;

detecting an output value of the second air-fuel ratio sensor wherein the output value is indicative of a rich or lean exhaust gas air-fuel ratio and, in response;

setting a proportional gain term of the second feedback loop as a function of the output value and the engine speed and load;

monitoring the engine mass airflow; and reducing the proportional gain term as a function of the engine mass airflow.

8. The method as set forth in claim 7 further comprising the steps of:

providing an air-fuel ratio bias table in said first feedback loop for compensating for errors associated with the first air-fuel ratio sensor; and altering the transfer characteristic of said first feedback loop as a function of the output value of the second air-fuel ratio sensor and the engine speed and load.

9. An air-fuel ratio control system for an internal combustion engine having an exhaust passage including a catalytic converter the control system comprising:

a first air-fuel ratio sensor positioned in the exhaust passage upstream of the catalytic converter for providing a first air-fuel ratio signal indicative of the air-fuel ratio of the exhaust gas upstream of the catalytic converter;

a second air-fuel ratio sensor positioned in the exhaust passage downstream of the catalytic converter for providing a second air-fuel ratio signal indicative of the air-fuel ratio of the exhaust gas downstream of the catalytic converter;

an airflow sensor coupled to the engine for measuring the engine inlet mass airflow;

a post-catalyst sensor feedback controller coupled to the second air-fuel ratio sensor for providing a post-catalyst proportional feedback gain as a function of the engine speed, engine load and the second air-fuel ratio sensor signal;

an air-fuel feedback controller coupled to the first air-fuel ratio sensor for generating an air-fuel ratio control signal;

a base fuel controller coupled to the engine for controlling the introduction of fuel into the engine and coupled to the air-fuel feedback controller for receiving the air-fuel ratio control signal, the base fuel controller including memory and a central processing unit programmed to perform the following steps:

set the proportional feedback gain term as a function of the second air-fuel ratio signal and the engine speed and load;

monitor the engine mass airflow; and modify the proportional feedback gain term as a function of the engine mass airflow.

10. The air-fuel ratio control system of claim 9 further comprising:

an air-fuel ratio bias table storing an air-fuel ratio trim value as a function of engine speed and load, said air-fuel ratio bias table providing an air-fuel bias signal; and a summer coupled to the air-fuel ratio bias table and the post-catalyst feedback controller, said summer for receiving said air-fuel bias signal and said post-catalyst proportional feedback gain and transmitting a processed bias signal to said air-fuel feedback controller.

11. The air-fuel ratio control system of claim 9 wherein said first and second air-fuel ratio sensors are exhaust gas oxygen sensors.

12. The air-fuel ratio control system of claim 9 wherein said first and second air-fuel ratio sensors are heated exhaust gas oxygen sensors.

13. The air-fuel ratio control system of claim 9 wherein said airflow sensor is positioned within the air intake of said engine.

14. An air-fuel ratio control system for an internal combustion engine having an exhaust passage including a catalytic converter the control system comprising:

a first air-fuel ratio sensor positioned in the exhaust passage upstream of the catalytic converter for providing a first air-fuel ratio signal indicative of the air-fuel ratio of the exhaust gas upstream of the catalytic converter;

a second air-fuel ratio sensor positioned in the exhaust passage downstream of the catalytic converter for providing a second air-fuel ratio signal indicative of the air-fuel ratio of the exhaust gas downstream of the catalytic converter;

an airflow sensor positioned within the exhaust passage of said engine for measuring the engine inlet mass airflow;

a post-catalyst sensor feedback controller coupled to the second air-fuel ratio sensor for providing a post-catalyst proportional feedback gain as a function of the engine speed, engine load and the second air-fuel ratio sensor signal;

an air-fuel feedback controller coupled to the first air-fuel ratio sensor for generating an air-fuel ratio control signal;

a base fuel controller coupled to the engine for controlling the introduction of fuel into the engine and coupled to the air-fuel feedback controller for receiving the air-fuel ratio control signal, the base fuel controller including memory and a central processing unit programmed to perform the following steps:

set the proportional feedback gain term as a function of the second air-fuel ratio signal and the engine speed and load;

monitor the engine mass airflow; and modify the proportional feedback gain term as a function of the engine mass airflow.

* * * * *